US007604070B2

(12) United States Patent
Kemppainen

(10) Patent No.: US 7,604,070 B2
(45) Date of Patent: Oct. 20, 2009

(54) ARRANGEMENT FOR CONTROLLING PERCUSSIVE ROCK DRILLING

(75) Inventor: Timo Kemppainen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 99 days.

(21) Appl. No.: 11/663,590

(22) PCT Filed: Sep. 22, 2005

(86) PCT No.: PCT/FI2005/050325

§ 371 (c)(1),
(2), (4) Date: Mar. 23, 2007

(87) PCT Pub. No.: WO2006/032733

PCT Pub. Date: Mar. 30, 2006

(65) Prior Publication Data

US 2008/0087467 A1 Apr. 17, 2008

(30) Foreign Application Priority Data

Sep. 24, 2004 (FI) ..... 20045352

(51) Int. Cl.
*E21B 44/02* (2006.01)

(52) U.S. Cl. ..... 173/1; 173/91; 173/104; 173/112

(58) Field of Classification Search ..... 173/1, 173/176, 91, 104, 112; 175/27
See application file for complete search history.

(56) References Cited

U.S. PATENT DOCUMENTS 3,561,542 A * 2/1971 Hanson et al. ..... 173/1
3,979,944 A 9/1976 Salmi et al.
4,165,789 A * 8/1979 Rogers ..... 175/27
4,246,973 A 1/1981 Mayer
4,356,871 A 11/1982 Fujikawa
4,440,236 A 4/1984 Shiihara et al.
4,449,592 A * 5/1984 Mayer ..... 175/52
4,983,256 A 1/1991 Combette et al.
5,129,466 A * 7/1992 Bartels et al. ..... 173/13
5,458,207 A * 10/1995 Mattero ..... 175/27
5,699,261 A * 12/1997 Muona ..... 700/160

(Continued)

FOREIGN PATENT DOCUMENTS

FI 55892 9/1975

(Continued)

OTHER PUBLICATIONS

Supplementary European Search Report dated May 21, 2008 issued in European Application No. 05789980.9.

*Primary Examiner*—Brian D Nash
(74) *Attorney, Agent, or Firm*—Drinker Biddle & Reath LLP

(57) ABSTRACT

A method and a storage device including a software product for controlling percussive rock drilling, and further a rock drilling rig to which the method is applied. The rotation resistance is monitored, the aim being to keep it below a desired reference value. To adjust the rotation resistance, successive control actions may be carried out, such as decreasing the feed force, decreasing the percussion power and stopping the feed. Control actions are started once a limit set for the control has been exceeded. At least one limit is a time limit determining the time difference between two successive control functions.

25 Claims, 3 Drawing Sheets

U.S. PATENT DOCUMENTS

| | | | | |
|---|---|---|---|---|
| 6,253,860 | B1 * | 7/2001 | Poysti et al. | 173/1 |
| 6,293,359 | B1 * | 9/2001 | Dobran et al. | 175/195 |
| 6,732,813 | B1 | 5/2004 | Eklof | |
| 7,198,117 | B2 * | 4/2007 | Uitto | 175/27 |
| 2001/0050186 | A1 * | 12/2001 | Wilson et al. | 175/38 |
| 2004/0140112 | A1 * | 7/2004 | Salminen et al. | 173/1 |
| 2004/0251049 | A1 * | 12/2004 | Keskiniva | 175/50 |

FOREIGN PATENT DOCUMENTS

| | | | |
|---|---|---|---|
| FI | 81174 | | 9/1975 |
| FI | 88186 | | 5/1985 |
| FI | 844200 | | 5/1985 |
| FI | 891626 | | 10/1989 |
| FI | 962622 | | 12/1997 |
| FI | 105943 | | 6/1998 |
| FI | 108564 | | 6/1998 |
| FI | 964990 | | 6/1998 |
| WO | 97/49895 | | 12/1997 |
| WO | 98/57033 | | 12/1998 |
| WO | 03/050388 | A1 | 6/2003 |

* cited by examiner

ARRANGEMENT FOR CONTROLLING PERCUSSIVE ROCK DRILLING

BACKGROUND OF THE INVENTION

In percussive rock drilling it is known to use what is called torque control, which aims at keeping the rotating pressure of the rotation motor of the rock drilling machine constant by adjusting the feed device of the rock drilling machine. When the rotation torque increases, the feed is decreased so as to re-obtain desired rotation torque. If, despite the decrease in the feed, the rotation torque does not get lower, the result may be drilling with underfeeding. In addition, the result may be that the drill bit gets stuck. As generally known, one problem with drilling with underfeeding is that the contact between the drill bit and the rock is reduced, which leads to a reduction in the drilling power. Further, underfeeding may result in tensile stress in the drilling equipment, which loads the joints between the drilling rods.

The invention relates to a method for controlling percussive rock drilling, the method comprising: controlling a percussion device in a rock drilling machine that gives impact pulses to a tool connected to the rock drilling machine during the drilling; controlling a rotating device in the rock drilling machine, the tool being rotated around its longitudinal axis during the drilling; controlling a feed device feeding the rock drilling machine during the drilling towards the rock to be drilled and correspondingly backwards; determining, during the drilling, at least rotation resistance, and registering a first moment of time when the rotation resistance exceeds a predetermined reference limit for the rotation resistance; and decreasing the feed to control the rotation resistance towards the predetermined reference limit for the rotation resistance.

The invention further relates to a software product for controlling percussive rock drilling, the execution of the software product in a control unit controlling the rock drilling being arranged to provide at least the following actions: to control, in a rock drilling machine, a percussion device for giving impact pulses to a tool connected to the rock drilling machine during the drilling, a rotating device for rotating the tool around its longitudinal axis during the drilling, and a feed device for feeding the rock drilling machine during the drilling towards the rock to be drilled and correspondingly backwards; and further, to determine, during the drilling, at least rotation resistance, and to register a first moment of time when the rotation resistance exceeds a predetermined reference limit for the rotation resistance; and to decrease the feed to control the rotation resistance towards the predetermined reference limit for the rotation resistance.

Still further, the invention relates to a rock drilling rig comprising: a carrier; at least one feed beam; at least one rock drilling machine movably arranged on the feed beam; a feed device for feeding the rock drilling machine towards the rock to be drilled and correspondingly backwards; the rock drilling machine comprising a percussion device for generating impact pulses for a tool connected to the rock drilling machine, and a rotating device for rotating the tool around its longitudinal axis; at least one control unit for controlling the functions of at least the feed device, percussion device and rotating device in accordance with a control strategy in the control unit; and means for determining at least rotation resistance; and the control unit being arranged to register a first moment of time when the rotation resistance exceeds a predetermined reference limit for the rotation resistance, and to decrease the feed for controlling the rotation resistance towards the predetermined reference limit for the rotation resistance.

BRIEF DESCRIPTION OF THE INVENTION

An object with this invention is to provide a novel and an improved method and arrangement for controlling rock drilling.

The method according to the invention is characterized by determining at least a first limit and a second limit for the control, at least one of the limits being a time limit; carrying out at least one control action for adjusting the rotation resistance at the moment of time corresponding to each limit; setting the time difference between the starting moments of successive control actions according to the time limit; and further, decreasing the percussion power if the rotation resistance is greater than the reference limit for the rotation resistance at the second moment of time corresponding to the first limit; and stopping the feed if the rotation resistance is greater than the reference limit for the rotation resistance at the third moment of time corresponding to the second limit.

The software product according to the invention is characterized in that the execution of the software product in the control unit is further arranged: to determine at least a first limit and a second limit for the control, at least one of the limits being a time limit; to carry out at least one control action for adjusting the rotation resistance at the moment of time corresponding to each limit; to set the time difference between the starting moments of successive control actions according to the time limit; to decrease the percussion power if the rotation resistance is greater than the reference limit for the rotation resistance at the second moment of time corresponding to the first limit; and to stop the feed if the rotation resistance is greater than the reference limit for the rotation resistance at the third moment of time corresponding to the second limit.

The rock drilling rig according to the invention is characterized in that the control unit is arranged to determine at least a first limit and a second limit for the control, at least one of the limits being a time limit; to carry out at least one control action for adjusting the rotation resistance at the moment of time corresponding to each limit; to set the time difference between the starting moments of successive control actions according to the time limit; to decrease the percussion power if the rotation resistance is greater than the reference limit for the rotation resistance at the second moment of time corresponding to the first limit; and to stop the feed if the rotation resistance is greater than the reference limit for the rotation resistance at the third moment of time corresponding to the second limit.

A second rock drilling rig according to the invention is characterized in that the control unit is arranged to determine, for the control, at least one time limit that is monitored from the first moment of time onwards; and that the control unit is arranged to carry out at least one control action for adjusting the rotation resistance at the second moment of time corresponding to the time limit.

An essential idea of the invention is to determine drilling resistance in percussive rock drilling and to maintain the drilling resistance at a desired drilling resistance reference value. If the drilling resistance exceeds the reference value, the feed is decreased in accordance with the control strategy. If decreasing the feed does not decrease the rotation resistance by the time the first limit is reached, the percussion power is subsequently decreased in accordance with the control strategy. Further, if decreasing the percussion power does not decrease the rotation resistance by the time the second limit is reached, the feed is subsequently stopped. The first limit and the second limit may be physical magnitudes, such as pressure, torque, force, voltage or power. Further, the first limit and the second limit may be limits expressing time. What is essential in the invention is that at least one of these limits is always a time limit. The time limit determines the time difference between the starting times of two successive control actions.

An essential idea of the control system of the second rock drilling machine of the invention is also to maintain the drilling resistance at a desired drilling resistance reference value. If the drilling resistance exceeds the reference value and stays greater than the reference value for a predetermined time despite the decreasing of the feed, the control system of the rock drilling rig carries out one or more control actions to adjust the rotation resistance at the second moment of time corresponding to the set time limit.

An advantage of the invention is that rock drilling can be controlled in a more versatile manner than before because not only maximum pressure limits or the like but also time-based limits can be defined for the control system. Thus, the control system is capable of controlling the drilling in advance in such a way that approaching an undesirable physical maximum limit, for instance the maximum pressure limit, can be avoided.

An essential idea of an embodiment of the invention is that a first time limit and a second time limit have been determined for the control system. The first time limit has been arranged to determine the moment of time when the decreasing of the percussion power is started. The second time limit, in turn, is arranged to determine the moment of time when the feed is stopped.

An essential idea of an embodiment of the invention is that at least one time limit is a predetermined fixed limit. The time limit may be set at the control unit rock-drilling-machine-specifically, or it may be set case-specifically before the drilling is started.

An essential idea of an embodiment of the invention is that the control unit is arranged to adjust at least one time limit in relation to the determined rotation resistance. In adjusting the time limit, the growth rate of the rotation resistance can be taken into consideration. On the other hand, when the time limit is adjusted, it can be taken into account how long a time the rotation resistance is greater than the reference value of the rotation resistance corresponding to normal drilling. Also a combination of the above aspects can be taken into account when the time limit is adjusted.

An essential idea of an embodiment of the invention is that a minimum limit has been set for the percussion power. If decreasing the percussion power has not resulted in a decrease in the rotation resistance by the time the percussion power reaches the minimum limit, the feed is stopped. In this way, it can be ensured that sufficient percussion power is always used. On the other hand, when the minimum limit for the percussion power has been obtained, it may be concluded that decreasing the rotation resistance further will not contribute to reducing the rotation resistance any longer but that another control action is needed in this situation.

An essential idea of an embodiment of the invention is that a maximum limit is set for the rotation resistance. At the moment of time when the rotation resistance exceeds this maximum limit, decreasing the percussion power is started. In addition to the maximum limit for the rotation resistance, there is a time limit in the control. If decreasing the percussion power has not, by the moment of time determined by the time limit, caused the rotation resistance to fall below the reference value of the rotation resistance, the feed is stopped.

An essential idea of an embodiment of the invention is that the percussion power is decreased in a linear manner.

An essential idea of an embodiment of the invention is that the percussion power is decreased in a non-linear manner, for instance stepwise or according to a mathematical function.

An essential idea of an embodiment of the invention is that the feed force is decreased in a linear manner.

An essential idea of an embodiment of the invention is that the feed force is decreased in a non-linear manner, for instance stepwise or according to a mathematical function.

An essential idea of an embodiment of the invention is that the direction of feed is reversed in relation to normal drilling if decreasing the percussion power and stopping the feed have not resulted in a decrease in the rotation resistance. The drilling resistance decreases at the latest when the drill bit is pulled out of the rock.

BRIEF DESCRIPTION OF THE FIGURES

The invention will now be described in greater detail in the attached drawings, in which.

For the sake of clarity, some embodiments of the invention are shown simplified in the figures. Similar parts and aspects are denoted with the same reference numerals.

DETAILED DESCRIPTION OF SOME EMBODIMENTS OF THE INVENTION

Figure 1:
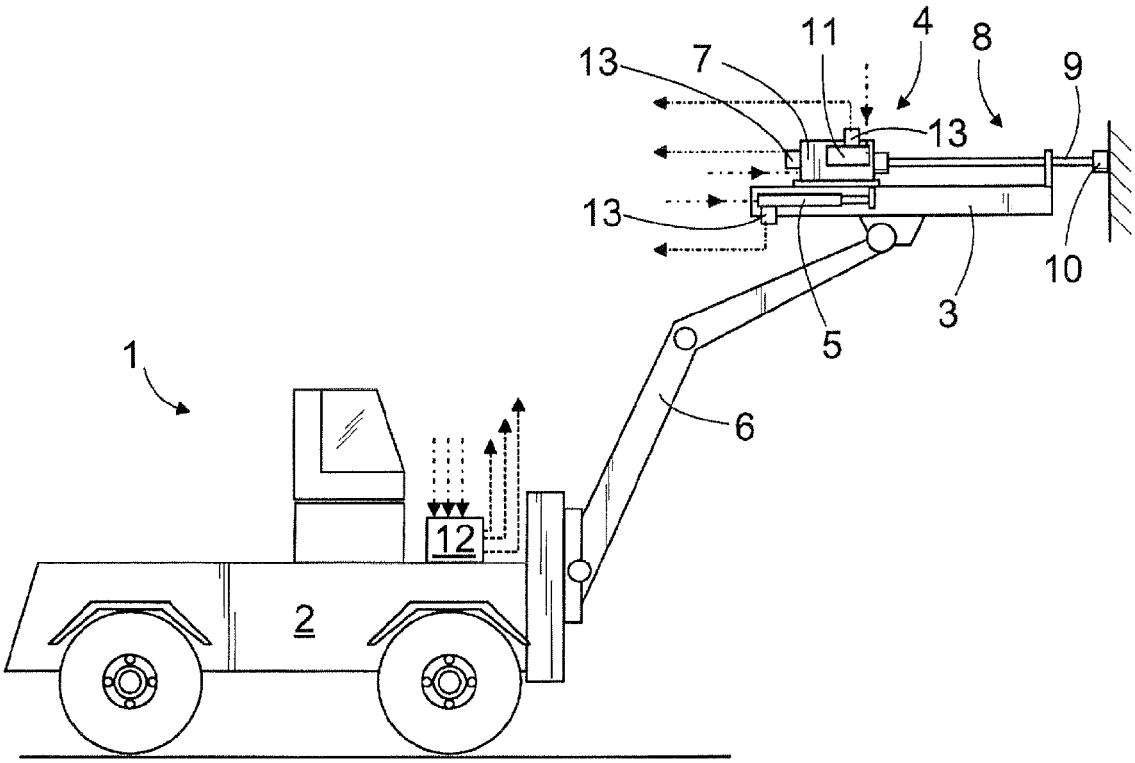
FIG. 1 shows schematically a side view of a rock drilling rig.

FIG. 1 shows a rock drilling rig 1 comprising a carrier 2 and at least one feed beam 3, on which a rock drilling machine 4 is movably mounted. The rock drilling machine 4 can be pushed towards the rock to be drilled and correspondingly pulled away from it by means of a feed device 5. The feed device 5 may comprise, for example, one or more hydraulic cylinders that may be arranged to move the rock drilling machine 4 by means of appropriate transmission members. Typically, the feed beam 3 is mounted on a boom 6 that can be moved in relation to the carrier 2. The rock drilling machine 4 comprises a percussion device 7 for giving impact pulses to a tool 8 connected to the rock drilling machine 4. The tool 8 may comprise one or more drill rods 9 and a drill bit 10. Further, the rock drilling machine 4 may comprise a rotating device 11 for rotating the tool around its longitudinal axis. During the drilling, impact pulses are given to the tool 8 by the percussion device 7, the tool being simultaneously rotated by means of the rotating device 11. Further, the rock drilling machine 4 is pushed, during the drilling, towards the rock in such a way that the drill bit 10 is able to break the rock. Rock drilling can be controlled with one or more control units 12. The control unit 12 may comprise a computer or a corresponding device. In order to control the drilling, for instance rotation resistance, percussion power and feed force can be measured with appropriate sensors 13. The measurement information may be led from the sensors 13 to the control unit 12, in which a control strategy may be set to control the rock drilling. It is also possible to determined the rotation resistance, percussion power and feed force by using indirect measurement and calculation. The control unit 12 may give control commands to actuators controlling the functioning of the rock drilling machine 4 and feed device 5, for instance to valves controlling the pressure medium. The percussion device 7, the rotating device 11 and the feed device 5 of the rock drilling machine 4 may be pressure-medium-actuated devices, in which case the magnitudes to be measured and controlled may be the pressures of the pressure medium. Alternatively, the actuators may be electric actuators, for example, in which case the magnitudes to be measured and controlled may be electric magnitudes. In FIG. 1, the course of the measurement and control information is denoted with dot-and-dash lines.

Figure 2:
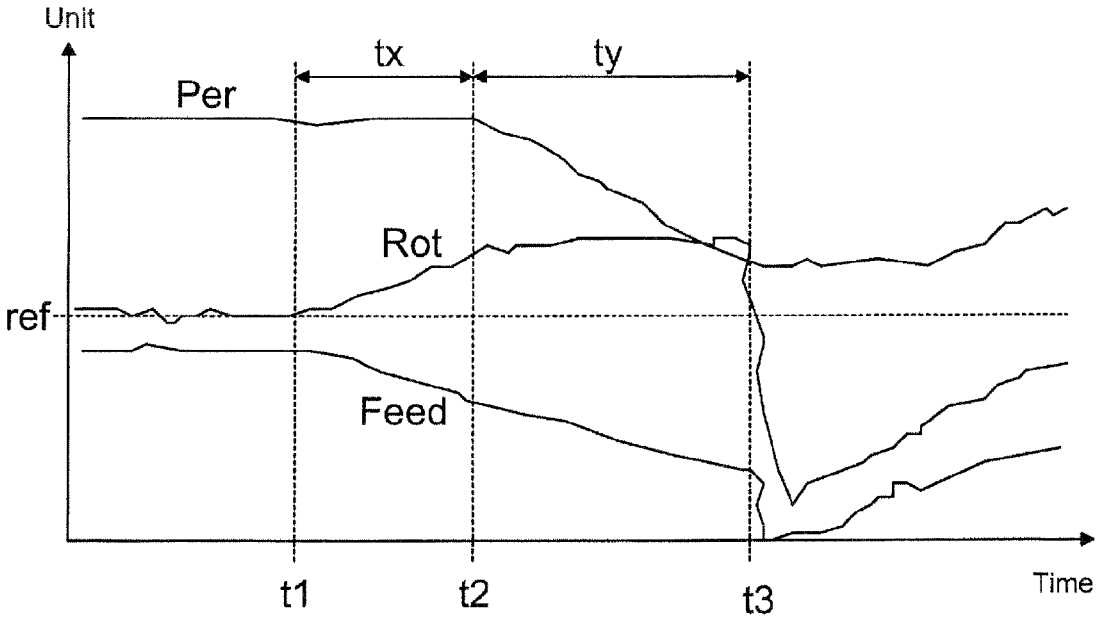
FIG. 2 shows schematically and with curves an embodiment of the control principle according to the invention.

FIG. 2 illustrates an embodiment of a control strategy according to the invention. FIG. 2 has three curves that express drilling values: a first curve (Rot) represents rotation resistance as a function of time, a second curve (Feed) represents feed as a function of time, and a third curve (Per) represents percussion power as a function of time. FIG. 2 also shows a horizontal dash line (ref) expressing the reference value of the rotation resistance. In an ordinary drilling situation, the rotation resistance (Rot) approximately conforms to the reference value (ref). At a moment of time t1, the rotation resistance (Rot) begins to increase significantly. Thus, the control unit 12 controlling the rock drilling begins to decrease the feed (Feed) in accordance with a predetermined control strategy. The feed (Feed) can be decreased by decreasing the feed force, feed velocity or both. Further, a time limit tx may be set at the control unit 12, and after the time determined by this time limit, i.e. at a moment of time t2, decreasing the percussion power (Per) is started in accordance with a predetermined control strategy. The percussion power (Per) is decreased only if the rotation resistance (Rot) has not, within the time determined by the time limit tx, returned to the reference value (ref) corresponding to an ordinary drilling situation. The feed (Feed) and the percussion power (Per) may be decreased substantially linearly, as shown in FIG. 2. If the rotation resistance (Rot) has not, in spite of the decreasing of the percussion power (Per), returned to the reference value (ref) within the time determined by the pre-set time limit ty, the feed can be stopped and, if required, reversed. Thus, at a moment of time t3, pulling of the rock drilling machine 4 away from the rock can be started. The drill bit 10 thus detaches from the rock, and there is a sudden drop in the drilling resistance, as seen from the curve (Rot). When the problem has been eliminated, the drilling can be continued by turning the feed direction to normal, and the percussion power (Per) and feed force or feed velocity can be gradually increased again. The time limits tx and ty may be set at the control unit 12 fixedly or they can be set case-specifically before each drilling time. In some cases, there may be three or more limits.

It is to be noted that after the decreasing of the percussion power (Per) has been started at the moment of time t2, the decreasing of the feed (Feed) can still be continued. The decreasing can be continued substantially evenly between the moments of time t1 and t3, or the decreasing can vary between t1 to t2 and t2 to t3. If the feed (Feed) has been decreased sufficiently, it is also possible to keep the feed (Feed) constant at t2 to t3 or part of this time, as shown later in FIG. 5.

In the control strategy described above, there are thus three control actions to be used, i.e. decreasing the feed, decreasing the percussion power and stopping the feed. The control strategy may further comprise reversing the direction of feed after the stopping. Further, implementing the control strategy requires at least measurement or other determination of the rotation resistance (Rot). In contrast, decreasing the percussion power, feed velocity and feed force can be carried out in accordance with an algorithm without the percussion power, feed velocity and feed force being measured.

Figure 3:
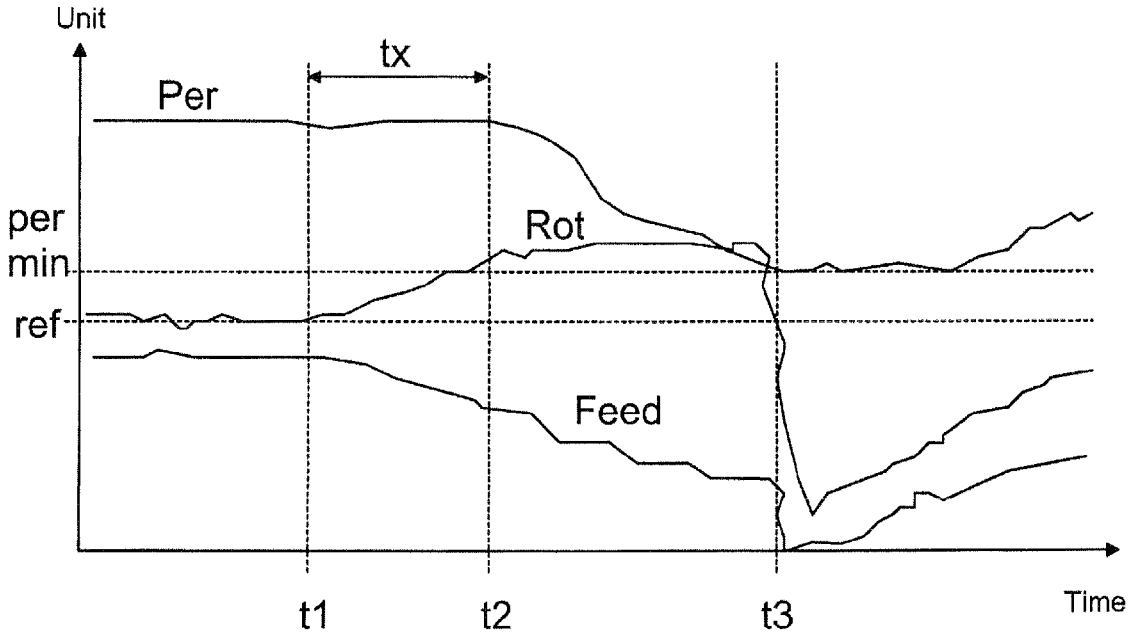
FIG. 3 shows schematically and with curves a second embodiment of the control principle according to the invention.

FIG. 3 shows a second embodiment of the control strategy according to the invention. The basic principle of the control and the control actions correspond to those shown in FIG. 2, but the difference in the solution of FIG. 3 is at least that only a first time limit tx has been set at the control unit 12. Further, a minimum limit (permin) has been set for the percussion power (Per). Thus, the direction of feed is reversed if the rotation resistance (Rot) has not decreased despite the decreasing of the percussion power (Per) and the percussion power (Per) reaches the set minimum limit (permin) for the percussion power. If the percussion device is a pressure-medium-actuated device, the limit (permin) may be, for instance, the minimum limit for percussion pressure. Yet another difference compared with the solution of FIG. 2 is that the percussion power (Per) is decreased in the time period t2 to t3 non-linearly. Decreasing the percussion power (Per) may conform to a continuous mathematical function, for instance. Decreasing the feed (Feed) can be carried out for example with one or more steps.

Figure 4:
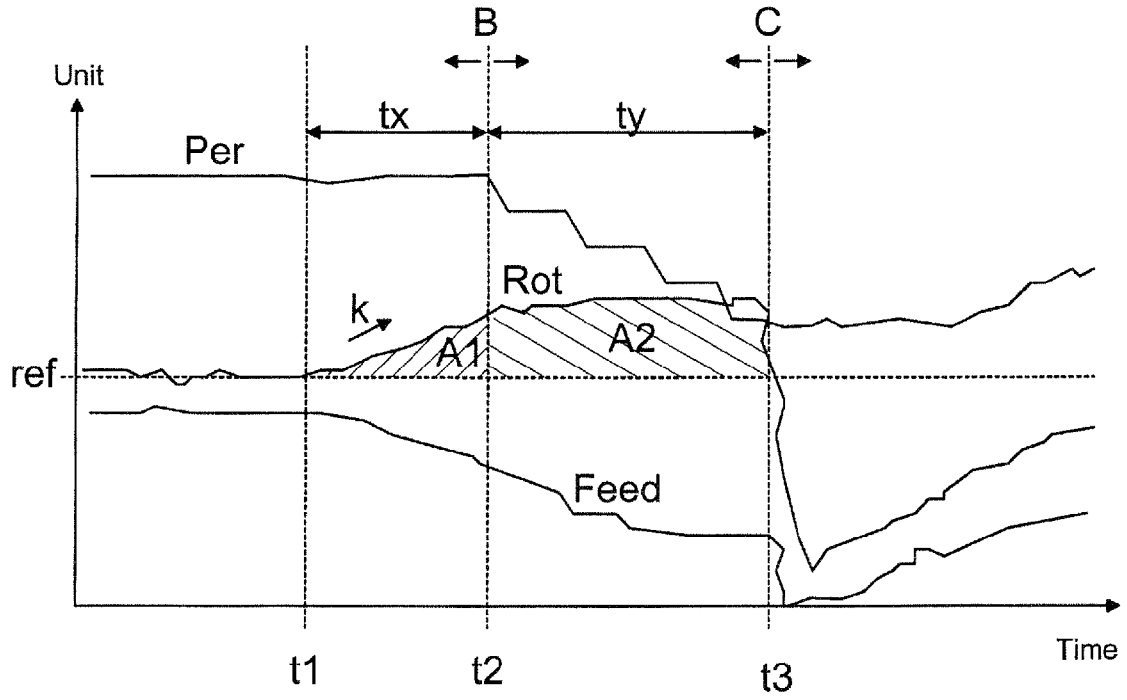
FIG. 4 shows schematically and with curves a third embodiment of the control principle according to the invention.

FIG. 4 shows a third embodiment of the control strategy according to the invention, where a starting moment t2 for decreasing the percussion power (Per) and a starting time t3 for stopping the feed and reversing the direction are determined by using time limits tx and ty adjusted according to the rotation resistance (Rot). The time limit tx may be arranged to be determined in the control unit 12 for instance according to how great the increase in the rotation resistance (Rot) is. This growth rate is denoted with an angular coefficient k in FIG. 4. On the other hand, the time limit tx may be determined according to how long a time the rotation resistance (Rot) has been greater than the reference value (ref) of the rotation resistance. Also a combination of the above ways can be used when adjusting the time limit tx. In this case, both the growth rate and the effective time can be taken into consideration in the adjustment. This combination is, in FIG. 4, illustrated by a first area A1, the size of which may be determined by mathematical means in the control unit 12. Further, the second time limit ty may be determined in the control unit 12 in a corresponding manner, i.e. on the basis of the rate of change or the time. Adjustment C of the second time limit ty may also be based on a combination of the above aspects. This combination is illustrated in FIG. 4 by a second area A2. Further, it is seen from FIG. 4 that decreasing the percussion power (Per) in the time period t2 to t3 may be carried out stepwise.

Figure 5:
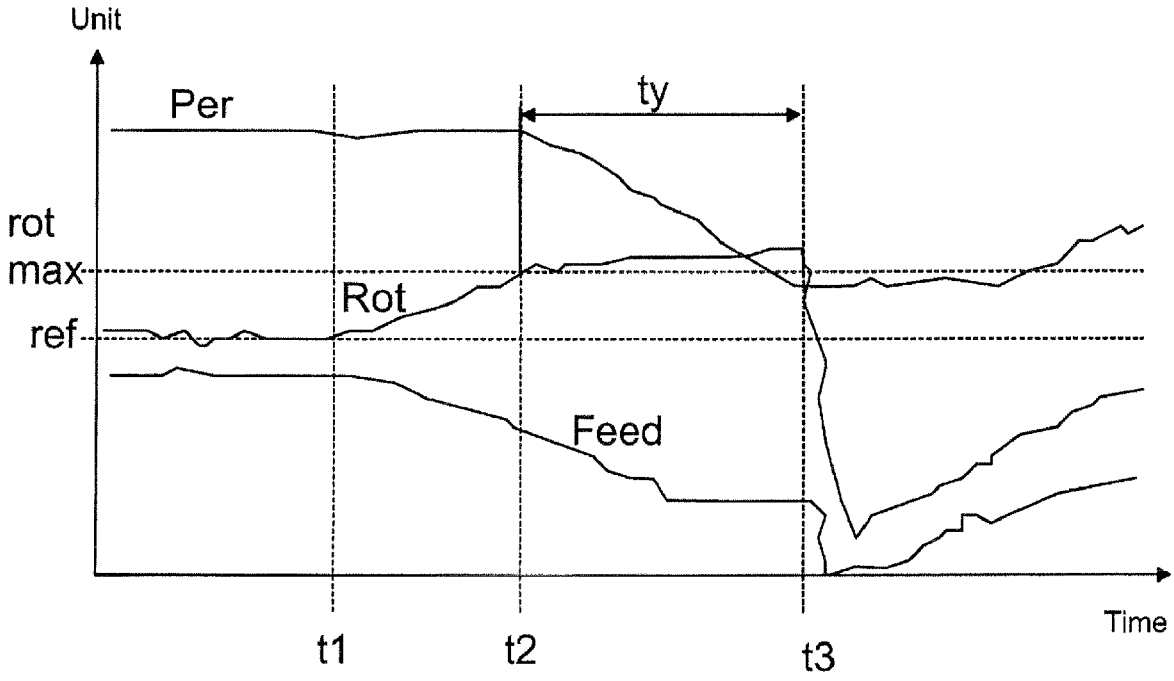
FIG. 5 shows schematically and with curves a fourth embodiment of the control principle according to the invention.

FIG. 5 shows a fourth embodiment of the control strategy according to the invention, in which a maximum limit (rotmax) has been set for the rotation resistance (Rot). If the rotation resistance (Rot) exceeds the maximum limit (rotmax), the percussion power (Per) is decreased at the moment of time t2 in accordance with the control strategy. Further, there is a predetermined or adjustable time limit ty in the control unit 12. If, despite the decreasing of the percussion power (Per), the rotation resistance (Rot) is still above the reference limit (ref) at the moment of time t3 determined by the time limit ty, the control unit 12 stops the feed and reverses the direction of feed, whereupon, at the latest, the rotation resistance (Rot) decreases.

In practice, changing the direction of feed from the ordinary direction to the opposite one always comprises the stopping of the feed. After the feed has been stopped, the direction of feed can be reversed substantially immediately or after a predetermined delay.

The rotation resistance (Rot) can be determined by measuring the pressure of the pressure medium, fed to the rotating device 11, or the pressure difference between the inlet channel and the outlet channel of the rotating device 11. Further, the rotation resistance (Rot) may be measured directly from the tool with appropriate sensors. The percussion power (Per) may be determined on the basis of the percussion pressure, flow and percussion frequency used, or it may be measured directly from the tool.

The method according to the invention may be carried out by running a computer program in a processor of one or more computers belonging to the control unit 12. A software product implementing the method of the invention may be stored in the memory of the control unit 12, or the software product may be loaded to a computer from a memory means, such as a CD-ROM disc. Further, the software product may be loaded from another computer, for instance via a data network, to a device belonging to the control system of a mining vehicle.

Adjusting the feed force, feed velocity and percussion power can be carried out in accordance with a desired control strategy. The feed force, feed velocity and percussion power can be decreased stepwise, linearly or in a suitable proportion in accordance with an appropriate mathematical function, for example. Adjusting the feed and the percussion power may thus be carried out with one or more adjustment steps of a predetermined size. The percussion pressure, for example, may be lowered with one adjustment step to predetermined half power. Further, the adjustment of the percussion pressure may be carried out in a suitable proportion to the feed pressure. It is also to be noted that instead of pressures, the object of consideration may be electric magnitudes, forces, powers, or other measurable or determinable magnitudes with which rotation resistance, percussion and feed can be determined.

It is yet to be noted that different combinations and modifications of the above adjustment strategies may be utilized in adjusting the drilling.

The drawings and the related specification are only intended to illustrate the idea of the invention. The details of the invention may vary within the scope of the claims.

The invention claimed is:

1. A method for controlling percussive rock drilling under the control of a control unit, the method comprising steps defined in a control strategy of the control unit and carried out by the control unit:

controlling a percussion device in a rock drilling machine that gives impact pulses to a tool connected to the rock drilling machine during the drilling, controlling a rotating device in the rock drilling machine, the tool being rotated round its longitudinal axis during the drilling, controlling a feed device feeding the rock drilling machine during the drilling towards the rock to be drilled and correspondingly backwards, determining, during the drilling, at least rotation resistance, and registering a first moment of time when the rotation resistance exceeds a predetermined reference limit for the rotation resistance, decreasing the feed to control the rotation resistance towards the predetermined reference limit for the rotation resistance, determining at least a first limit and a second limit for the control, at least one of the limits being a time limit, carrying out at least one control action for adjusting the rotation resistance at the moment of time corresponding to each limit, setting the time difference between the starting moments of successive control actions according to the time limit, and further, decreasing the percussion power if the rotation resistance is greater than the reference limit for the rotation resistance at the second moment of time corresponding to the first limit, and stopping the feed if the rotation resistance is greater than the reference limit for the rotation resistance at the third moment of time corresponding to the second limit.

2. A method according to claim 1, comprising determining a time limit as the first limit and a time limit as the second limit, determining the second moment of time corresponding to the first limit starting from the first moment of time, determining the third moment of time corresponding to the second limit starting from the second moment of time, decreasing the feed at least until the second moment of time, decreasing the percussion power between the second moment of time and the third moment of time if the rotation resistance is greater than the reference limit, and stopping the feed at the third moment of time if the rotation resistance is greater than the reference value.

3. A method according to claim 1, comprising determining a time limit as the first limit and a time limit as the second limit, determining the second moment of time corresponding to the first limit starting from the first moment of time, determining the third moment of time corresponding to the second limit starting from the second moment of time, decreasing the feed at least until the second moment of time, decreasing the percussion power between the second moment of time and the third moment of time if the rotation resistance is greater than the reference limit, and stopping the feed at the third moment of time if the rotation resistance is greater than the reference value, and determining the value of at least one time limit directly proportionally to the growth rate of the rotation resistance.

4. A method according to claim 1, comprising determining a time limit as the first limit and a time limit as the second limit, determining the second moment of time corresponding to the first limit starting from the first moment of time, determining the third moment of time corresponding to the second limit starting from the second moment of time, decreasing the feed at least until the second moment of time, decreasing the percussion power between the second moment of time and the third moment of time if the rotation resistance is greater than the reference limit, and stopping the feed at the third moment of time if the rotation resistance is greater than the reference value, and determining the value of at least one time limit directly proportionally to the duration the rotation resistance of which is greater than the reference limit.

5. A method according to claim 1, comprising determining a minimum limit for the percussion power and using it as the second limit, and determining the moment when the percussion power is smaller than the minimum limit as the third moment of time corresponding to the second limit.

6. A method according to claim 1, comprising determining a maximum limit for the rotation resistance and using it as the first limit, and determining the moment when the rotation resistance is greater than the maximum limit as the second moment of time corresponding to the first limit.

7. A method according to claim 1, comprising decreasing the feed substantially linearly between the first moment of time and the third moment of time.

8. A method according to claim 1, comprising decreasing the percussion power substantially linearly between the second moment of time and the third moment of time.

9. A method according to claim 1, comprising decreasing the percussion power non-linearly between the second moment of time and the third moment of time.

10. A method according to claim 1, comprising reversing the direction of feed if the rotation resistance is greater than the reference limit for the rotation resistance at the third moment of time corresponding to the second limit.

11. A method according to claim 1, comprising decreasing the feed force when decreasing the feed.

12. A method according to claim 1, comprising decreasing the feed velocity when decreasing the feed.

13. A rock drill including a software product capable of controlling percussive rock drilling, the execution of the software product in a control unit controlling the rock drilling being arranged to provide at least the following actions:

to control, in a rock drilling machine, a percussion device for giving impact pulses to a tool connected to the rock drilling machine during the drilling, a rotating device for rotating the tool around its longitudinal axis during the drilling, and a feed device for feeding the rock drilling machine during the drilling towards the rock to be drilled and correspondingly backwards and further, to determine, during the drilling, at least rotation resistance, and to register a first moment of time when the rotation resistance exceeds a predetermined reference limit for the rotation resistance, to decrease the feed to control the rotation resistance towards the predetermined reference limit for the rotation resistance, to determine at least a first limit and a second limit for the control, at least one of the limits being a time limit, to carry out at least one control action for adjusting the rotation resistance at the moment of time corresponding to each limit, to set the time difference between the starting moments of successive control actions according to the time limit, to decrease the percussion power if the rotation resistance is greater than the reference limit for the rotation resistance at the second moment of time corresponding to the first limit, and to stop the feed if the rotation resistance is greater than the reference limit for the rotation resistance at the third moment of time corresponding to the second limit.

14. The rock drill according to claim 13, wherein the first limit and the second limit are time limits.

15. The rock drill according to claim 13, wherein the first limit for determining the second moment of time is a time limit and the second limit for determining the third moment of time is the maximum limit for the rotation resistance.

16. The rock drill according to claim 13, wherein the first limit for determining the second moment of time is the minimum limit for the percussion power and the second limit for determining the third moment of time is a time limit.

17. The rock drill according to claim 13, wherein executing the software product is arranged to determine at least one time limit proportionally to the rotation resistance.

18. A rock-drilling rig comprising:

a carrier, at least one feed beam, at least one rock drilling machine movably arranged on the feed beam, a feed device for feeding the rock drilling machine towards the rock to be drilled and correspondingly backwards, the rock drilling machine comprising a percussion device for generating impact pulses for a tool connected to the rock drilling machine, and a rotating device for rotating the tool around its longitudinal axis, at least one control unit for controlling the functions of at least the feed device, percussion device and rotating device in accordance with a control strategy in the control unit, and pressure sensing means arranged in at least one pressure medium channel of the rotation device, whereby the control unit determines the rotation resistance on the basis of the measurement data, and the control unit being arranged to register a first moment of time when the rotation resistance exceeds a predetermined reference limit for the rotation resistance, and to decrease the feed for controlling the rotation resistance towards the predetermined reference limit for the rotation resistance, and further, the control unit is arranged to determine at least a first limit and a second limit for the control, at least one of the limits being a time limit, to carry out at least one control action for adjusting the rotation resistance at the moment of time corresponding to each limit, to set the time difference between the starting moments of successive control actions according to the time limit, to decrease the percussion power if the rotation resistance is greater than the reference limit for the rotation resistance at the second moment of time corresponding to the first limit, and to stop the feed if the rotation resistance is greater than the reference limit for the rotation resistance at the third moment of time corresponding to the second limit.

19. A rock-drilling rig comprising:

a carrier, at least one feed beam, at least one rock drilling machine movably arranged on the feed beam, a feed device for feeding the rock drilling machine towards the rock to be drilled and correspondingly backwards, the rock drilling machine comprising a percussion device for generating impact pulses for a tool connected to the rock drilling machine, and a rotating device for rotating the tool around its longitudinal axis, at least one control unit for controlling the functions of at least the feed device, percussion device and rotating device in accordance with a control strategy in the control unit, and pressure sensing means arranged in at least one pressure medium channel of the rotation device, whereby the control unit determines the rotational resistance on the basis of the measurement data, and the control unit being arranged to register a first moment of time when the rotation resistance exceeds a predetermined reference limit for the rotation resistance, and to decrease the feed for controlling the rotation resistance towards the predetermined reference limit for the rotation resistance, and further the control unit is arranged to determine, for the control, at least one time limit that is monitored from the first moment of time onwards, and that the control unit is arranged to carry out at least one control action for adjusting the rotation resistance at the second moment of time corresponding to the time limit.

20. A rock drilling rig according to claim 19, wherein the control unit is arranged to decrease the percussion power at the moment of time corresponding to the time limit for adjusting the rotation resistance.

21. A rock drilling rig according to claim 19, wherein the control unit is arranged to decrease the feed velocity at the moment of time corresponding to the time limit for adjusting the rotation resistance.

22. A rock drilling rig according to claim 19, wherein the control unit is arranged to stop the feed at the moment of time corresponding to the time limit for adjusting the rotation resistance.

23. A rock drilling rig according to claim 19, wherein the control unit is arranged to stop the feed at the moment of time corresponding to the time limit and to reverse the direction of feed for adjusting the rotation resistance.

24. A rock-drilling rig comprising:

a carrier, at least one feed beam, at least one rock drilling machine movably arranged on the feed beam, a feed device for feeding the rock drilling machine towards the rock to be drilled and correspondingly backwards, the rock drilling machine comprising a percussion device for generating impact pulses for a tool connected to the rock drilling machine, and a rotating device for rotating the tool around its longitudinal axis, at least one control unit for controlling the functions of at least the feed device, percussion device and rotating device in accordance with a control strategy in the control unit, and a sensor arranged in the tool in order to measure rotation resistance directly from the tool, and the control unit being arranged to register a first moment of time when the rotation resistance exceeds a predetermined reference limit for the rotation resistance, and to decrease the feed for controlling the rotation resistance towards the predetermined reference limit for the rotation resistance, and further, the control unit is arranged to determine at least a first limit and a second limit for the control, at least one of the limits being a time limit, to carry out at least one control action for adjusting the rotation resistance at the moment of time corresponding to each limit, to set the time difference between the starting moments of successive control actions according to the time limit, to decrease the percussion power if the rotation resistance is greater than the reference limit for the rotation resistance at the second moment of time corresponding to the first limit, and to stop the feed if the rotation resistance is greater than the reference limit for the rotation resistance at the third moment of time corresponding to the second limit.

25. A rock-drilling rig comprising:

a carrier, at least one feed beam, at least one rock drilling machine movably arranged on the feed beam, a feed device for feeding the rock drilling machine towards the rock to be drilled and correspondingly backwards, the rock drilling machine comprising a percussion device for generating impact pulses for a tool connected to the rock drilling machine, and a rotating device for rotating the tool around its longitudinal axis, at least one control unit for controlling the functions of at least the feed device, percussion device and rotating device in accordance with a control strategy in the control unit, and a sensor arranged in the tool in order to measure rotation resistance directly from the tool, and the control unit being arranged to register a first moment of time when the rotation resistance exceeds a predetermined reference limit for the rotation resistance, and to decrease the feed for controlling the rotation resistance towards the predetermined reference limit for the rotation resistance, and further the control unit is arranged to determine, for the control, at least one time limit that is monitored from the first moment of time onwards, and that the control unit is arranged to carry out at least one control action for adjusting the rotation resistance at the second moment of time corresponding to the time limit.

* * * * *